United States Patent [19]

Hüsler

[11] Patent Number: 4,644,596

[45] Date of Patent: Feb. 24, 1987

[54] RESILIENT SURFACE FOR SITTING AND LYING FURNITURE, PREFERABLY FOR BEDS

[75] Inventor: Balthasar Hüsler, Goldau, Switzerland

[73] Assignee: Liform AG, Zug, Switzerland

[21] Appl. No.: 741,309

[22] PCT Filed: Sep. 14, 1984

[86] PCT No.: PCT/CH84/00146

§ 371 Date: May 30, 1985

§ 102(e) Date: May 30, 1985

[87] PCT Pub. No.: WO85/01425

PCT Pub. Date: Apr. 11, 1985

[30] Foreign Application Priority Data

Sep. 30, 1983 [CH] Switzerland ..... 5296/83

[51] Int. Cl.[4] ..... A47C 23/06

[52] U.S. Cl. ..... 5/236 R; 5/191; 5/237

[58] Field of Search ..... 5/236 R, 236 B, 237, 5/191, 241, 242, 474, 465

[56] References Cited

U.S. PATENT DOCUMENTS 4,567,615 2/1986 Fantl ..... 5/237

FOREIGN PATENT DOCUMENTS 2059369 6/1971 Fed. Rep. of Germany ..... 5/191

2603519 8/1977 Fed. Rep. of Germany .

*Primary Examiner*—Alexander Grosz

*Attorney, Agent, or Firm*—Walter C. Farley

[57] ABSTRACT

A bed includes a support structure having longitudinally extending bearing beams on which a spring member rests. The spring member includes a plurality of side-by-side modules, each having upper and lower resilient, flexible strips held apart by a plurality of spacers. The spacers are offset from the bearing members so that the upper strip of each module hold the modules together to allow limited independent movement. A pad and a removable fabric cover is provided.

12 Claims, 6 Drawing Figures

RESILIENT SURFACE FOR SITTING AND LYING FURNITURE, PREFERABLY FOR BEDS

The invention relates to the field of sitting and lying furniture, particularly beds. The prior art in this field is presently unsatisfactory in several respects. The main criteria for the quality of a bed can be looked upon as hygiene, orthopedics, handiness and biology. The requirements regarding optimum construction and the prior art are subdivided hereinafter on the basis of these criteria.

BACKGROUND OF THE INVENTION

Hyqiene

A good bed must be able to breath, i.e. the removal of the moisture (approximately 2 to 5 dl per night) given off by the human skin when sleeping must not be impeded by moisture-impermeable layers. Thus, during its use period the lying surface is permeated by the waste substances and bacteria given off with the moisture. It has therefore been necessary to clean the breathing-active parts of the bed, particularly after a bed has been used by a sick person or in hospitals and hotels in which several people successively use the same bed. This is only possible to a limited extent with the presently used lying surface constructions, because the mattresses, which are usually very large, cannot be cleaned or can only be cleaned with considerably difficulty. As a result, e.g. in hospitals, moisture-impermeable layers of plastic or the like are by sheer necessity placed on the mattress to prevent the penetration of infectious germs. This stops the breathability of the mattress and the bed user must lie on the resulting moisture deposits, which leads to bed sores in patients. In the home, mattresses are generally not cleaned throughout the period of use which can be several decades. The same problem occurs in hotels where, in addition, beds are used by various people. The need thus becomes apparent for a mattress made in such a way that it can be easily cleaned, preferably by the user.

Orthopedics

A good lying surface must be such that the human body is supported in an optimum manner in its normal sleeping position (on the back, side or stomach) and consequently remains in a relaxed state. The requirements concerning the design of this lying surface are dependent on the weight, size, sleeping position and possible anatomical peculiarities (particularly the vertebral column) of the persons using the bed and cannot therefore be easily standardized. Account must also be taken of subjective wishes of the user such as the preference for a harder or softer support. Thus, the lying surface must be adaptable to the individual user. This is possible to a limited extent at present only if the person in question is in a position to pay for the expensive individual production of a custom-made lying surface. Although reasonably priced designs often permit individual adjustment possibilities, they far from fulfill the aforementioned requirements. They are also mainly designed for persons who sleep on the side and back, ignoring the fact that a large percentage of the population sleep on the stomach and require a quite different lying surface design. The need thus becomes apparent to make these possibilities available with simple means for the normal citizen.

A further criterion is the fact that many of the available lying surfaces lose their elasticity and springiness and consequently their original shape after a few years of use and that it is only possible to make good this deficiency, i.e. restore the initial elasticity, shape and springiness by incurring considerable expenditure or not at all. Thus, the ideal solution would be to provide a design enabling the user to eliminate this problem caused by material deformation and fatigue by using simple means.

Handiness

All existing lying surfaces with at least an average lying quality have a relatively high weight. Particularly in the case of French beds, it is often impossible for housewives and older people to move the lying surfaces, so that it would be appropriate to provide a lightweight, easily handlable design.

Bioloqy

A steadily increasing number of people are of the opinion that, as a result of body influences when sleeping, all metals and synthetic materials should be excluded from use in beds. At present, the prior art discloses no design, in which this possibility is 100% achievable, while simultaneously retaining the orthopedic quality of the lying surface. A solution for this is therefore desirable.

SUMMARY OF THE INVENTION

Accordingly, an object of the invention is to satisfy these various requirements concerning a lying surface in a simple, inexpensive manner by means of a standard design.

Briefly described, the invention includes a support structure for a bed or the like having elongated bearing members on which a plurality of springy modules rest. Each module includes two resilient, parallel strips and spacers between the strips, the spacers being positioned so that they are offset from the bearing members. The ends of the modules are held together and to each other by fabric which allows relative movement between modules. The support structure holds a pad on which a person can sit or lie.

This objective is achieved by the invention according to the main claim. The invention is described in greater detail hereinafter relative to the drawings, wherein:

FIG. 1*a* is a transverse sectional view of a spring member comprising bearing members, strips, spacers and fabric;

FIG. 1*b* is a longitudinal sectional view of a spring member according to FIG. 1*a*;

DESCRIPTION OF THE PREFERRED EMBODIMENT

Figure 1A:
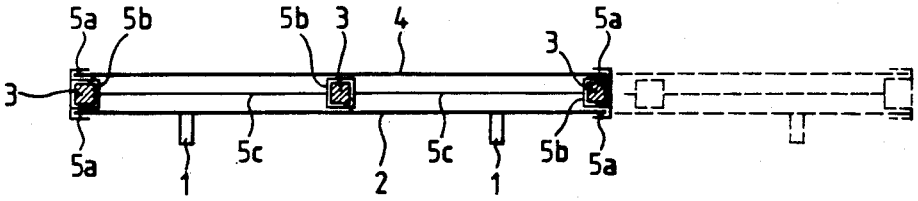
Figure 1B:
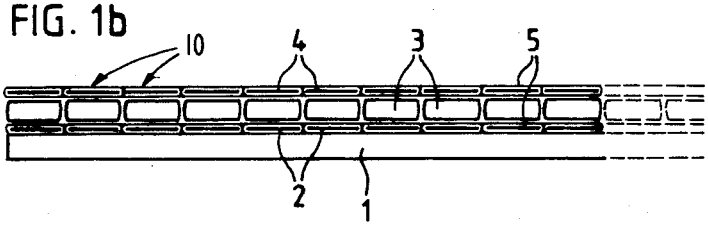

FIGS. 1*a* and 1*b* show the construction of the basic component according to the invention, which will be referred to as a spring member or support structure. The function of this basic component is to produce the same, controllable spring tension at all points on its surface. The spring member, as seen in FIGS., 1*a*, 1*b* and 5, includes a plurality of interconnected but relatively movable segments or modules 10 each including lower and upper elongated flexible strips 2 and 4 separated by three spacers 3 which are located between strips 2,4 at the ends and at the middle. A plurality of modules 10 are arranged side-by-side from one end of the bed to the other, each module extending across the bed. Bearing supports 1, which are substantially rigid, extend the length of the bed beneath the modules to support them, the bearing members being separated by a distance sufficient to engage the modules about midway between spacers 3. The ends of adjacent modules are joined by a covering of fabric 5. Due to the fact that the spacers 3 positioned between the flexible strips 2,4 are displaced with respect to the bearing members 1, the surface of the upper strip 4 can be pressed downwards at all points. The spring tension produced is dependent on the bending strength of the strips (thicker=harder) and the distance between the bearing members and the spacers (shorter=harder).

If the strips 2,4 in the direction of the bearing members (longitudinal direction) were produced from one piece (a plate), the result would be significant stiffening which would prevent or limit bending when the surface is loaded so that flexibility would be prevented in the longitudinal direction. As this flexibility is particularly important in beds for the anatomically correct support of the body, the basic component according to the invention is subdivided into individual modules in the longitudinal direction (FIG. 1*b*). Thus, both the strips 2,4 and the spacers 3 are made in separate pieces. Modules with a width between 6 and 15cm have proved to be the optimum correct subdivision, economically and anatomically.

It is also important to choose the correct material for the strips. It must be flexible, i.e. it must bend under loading, but when the load is removed must immediately reassume its initial shape. This property should also be retained over a long period. In addition, if desired, the material must also be biological. Thus, suitable materials are solid wood (some types), glued plywood (made from veneers), fiberglass and fiberglass laminates, plastics (PVC, acrylics, etc.) and also, if desired, spring steel. In all cases, the edges must be such that the fabric 5 is not damaged.

In order that the spring action can be obtained, the spacers 3 must not be fixed to the strips 2, 4, such as by gluing or nailing. However, the complete entity must be held together and the individual parts correctly positioned. This problem is solved by a fabric 5, which holds together and interconnects the strips and spacers.

Fabric 5 is formed in such a way that it encloses and therefore positions the relatively short spacers 3 in tubular hoses 5*b*. The hoses must be formed in such a way that the spacers have some clearance, so as to not impede the flexibility of this "backbone" of the basic component. The length of the spacer is matched with the width of the strips such that each spacer is between a lower and an upper strip.

Figure 2:
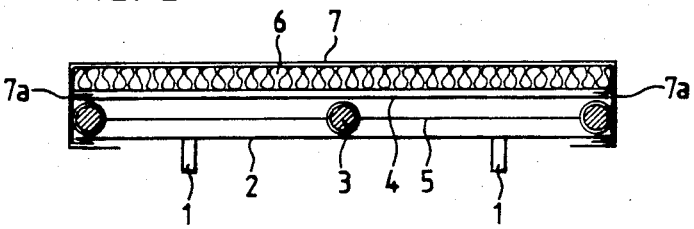
FIG. 2 is a transverse sectional view of a further embodiment of a spring member similar to FIG. 1*a*, but with circular spacers, together with a support and fabric enclosure.

Each spacer 3 can be rectangular or square in cross section (FIGS. 1*a* and 3) or circular (FIG. 2). The embodiment with the circular spacers has the following advantages:

- The introduction into the hoses is easier and cannot be carried out incorrectly.
- The bearing point on the strips becomes substantially zero;
- Less material is required; and
- They can be more rationally produced from solid wood.

Therefore, the circular solution is generally preferred.

Figure 4:
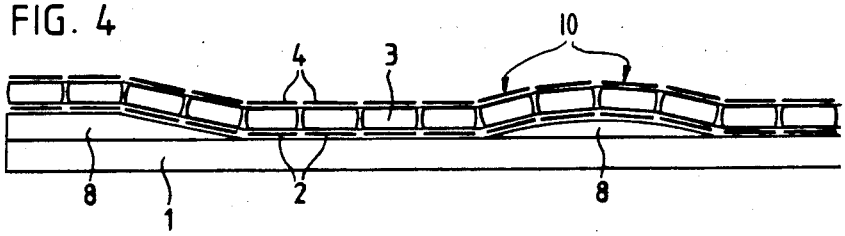
FIG. 4 is a longitudinal sectional view of a spring member according to FIG. 1*a* with two examples of means for modifying the surface shape of the spring member.

For completely satisfactory functioning, the end face of the spacer must be such that when the spring member is bent in the longitudinal direction (as shown in FIG. 4), there is no change in the overall length of the spring member as measured along the central longitudinal axis. This means that the spacers may only be in contact at one point or along one line between the upper and lower strips. Otherwise, upward or downward bending would lead to an extension of the length along the central axis.

It is unimportant for producing the spring action whether the spacers 3 are made from a solid or a compressible material. Thus, economic and possibly biological criteria are decisive for the choice of material to be used. Suitable materials are hollow plastic members or solid wood.

Fabric 5 is laterally equipped at the top and bottom with pockets 5*a*, which receive and position the ends of strips 2,4. These pockets are advantageously constructed in such a way that the strips can be inserted and removed again by bending. Thus, e.g. for a lying surface width of 90 cm, the ideal pocket depth is approximately 3 cm.

The complete spring member component is now stable and can be placed unconstrained on the two bearing members 1. It is kept in position by the conventional bed frame (head and footboard, as well as bedstead). It also has the advantage that it can be disassembled and reassembled by anybody and without requiring tools.

Figure 3:
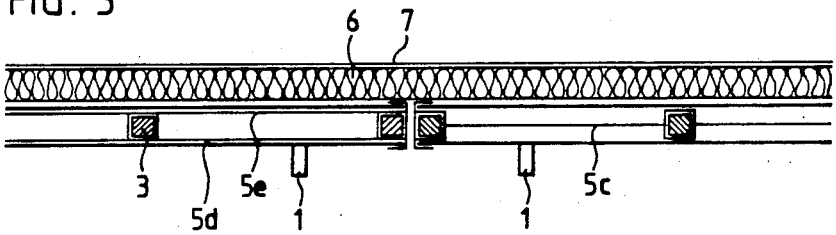
FIG. 3 is a transverse sectional view of two combined spring members, one according to FIG. 1*a*, in which the support and fabric enclosure are continuous, and in which one spring member has a two-layer fabric as a variant.

As a variation of the economic solution shown in FIG. 1*a*, wherein the fabric 5*c* is a single layer form, the fabric can be made so that it has two-layers as in the case of the left-hand spring member in FIG. 3 wherein the added fabric layers are identified as 5*d* and 5*e*. This additionally stiffens the spring member and also forms an air cushion between the strips.

Two embodiments are available for double beds. The component is either extended by a further bearing member and an additional spacer row (dotted line in FIG. 1*a*), or two spring members are used side-by-side (FIG. 3). The second solution has the advantage of isolation so that one sleeper does not notice when the other moves.

FIG. 2 shows in transverse cross-section a lying surface whose function corresponds to conventional mattresses including the lattice work. One or more layers of soft, warm, breathable material 6 are placed on top of the spring member and have the function of keeping the body warm, absorbing and.or transporting the moisture given off by the body and ensuring that the sleeper does not feel the edges of the upper strips 4. Suitable materials are foam, latex, horsehair, cocoa fibre, wool, synthetic fibers, etc individually or mixed together.

In order to hold the spring member and support 6 together and to give the assembly an appearance similar to standard mattresses, it is advantageous to provide the spring member and support with an enclosing fabrics. If the lateral edges 7*a* of this enclosing fabric are further reinforced by quilting, a clean, cubic appearance is obtained.

FIG. 4 shows the further important possibility resulting from the present invention, namely the change in the surface shape of the lying surface produced by very simple means. Arbitrarily shaped bodies 8 can be placed in any chosen position on the fundamentally flat bearing members 1. For example, the upper edges of the bearing members are provided with a uniform row of holes and the bodies 8 with matching dowels. Thus, on the basis of a basic construction, it is possible to produce virtually any surface shape, obviously taking account of the maximum bending radius of the spring member.

Figure 5:
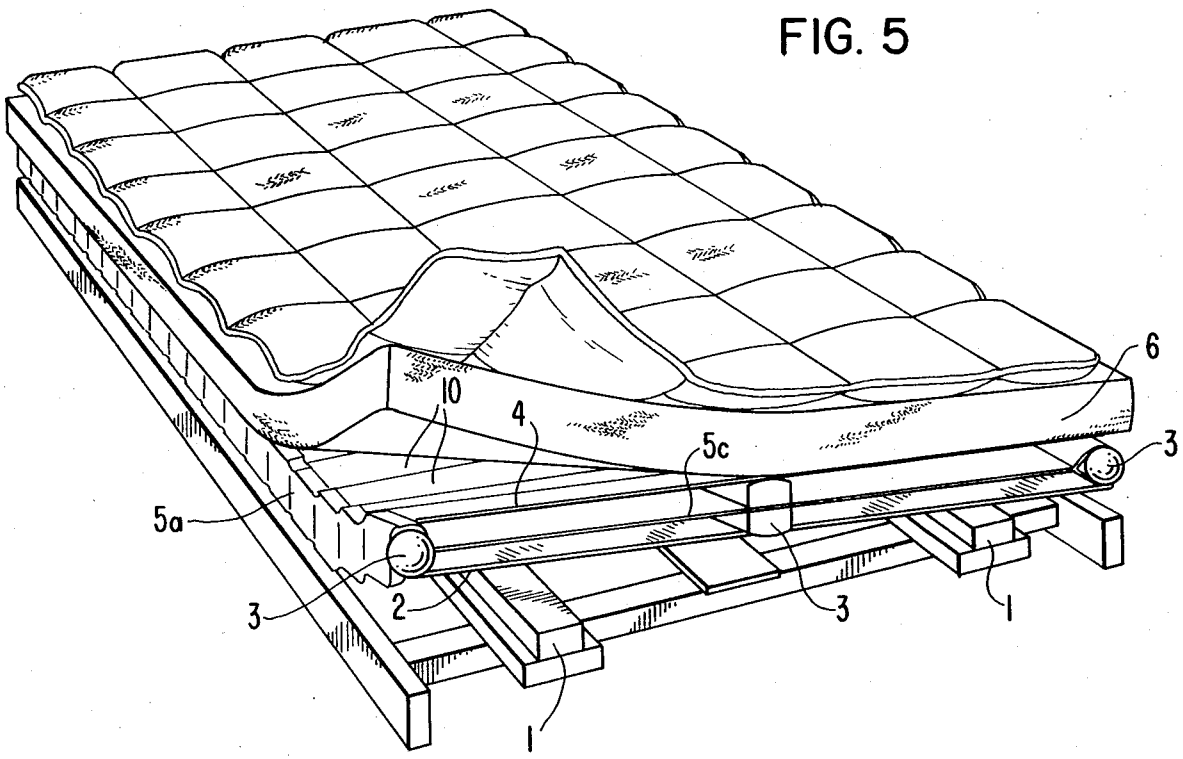
FIG. 5 is a perspective view of a bed made in accordance with the present invention and including a spring member similar to FIG. 1.

FIG. 5 shows a perspective view of a bed having a support structure in accordance with the invention. The bearing members are shown supported on a simple framework which can be a conventional bedstead. Modules 10 lie across the bearing members, the end modules and pad 6 being elevated to show fabric 5*C* and spacers 3. The cloth cover 5*a* encloses the ends of strips 2,4 and spacers 3.

Thus, with the lying surface as described according to the invention, the quality demands concerning a lying surface described above can be satisfied in a simple, inexpensive manner.

Hygiene

As the lying surface can be easily disassembled by anybody and the necessary breathing-active supports are much thinner than in conventional designs, the user can relatively easily clean the lying surface, so that the appropriate hygienic requirements are fulfilled.

Orthopedics

As only very thin supports are required, the supporting action of the spring member is completely transferred to the human body. Full support is ensured in any lying position, even to problemmatic areas such as, e.g., the hips. The spring tension, i.e. the softness of hardness of the lying surface can be modified selectively or over entire areas by the user by replacing the modules with those having thicker or thinner strips.

By placing additional shaped members of selected shape (e.g., in accordance with the doctor's instructions ), the lying surface top can be longitudinally caused to assume any desired shape by the user. By raising the central area of the lying surface, the person sleeping on the stomach can relieve the vertebral column, while preventing foot damage by raising it in the area of the lower part of the leg and providing a sharp bend at the ankle joints.

If in time the resilient elasticity of the strips decreases as a result of shape changes, their resilience can be completely restored by the user by merely turning them over. This is most conveniently carried out when the bed is cleaned. This fulfills the requirements for permanent, orthopedically correct lying.

Handiness

As a result of the simple, disassemblable construction, easy handling is possible, even for older people, and others with minimal strength.

Biology

As no compressible parts are required in the lying surface according to the invention, it can be made from solid wood, natural fibers, horsehair and sheep's wool. Thus, it does not need to contain metal parts or any synthetic materials or additives (as are indispensable in the case of natural rubber), so that it fully satisfies anthroposophysical principles.

Thus, the invention essentially comprises a resilient surface, which is obtained in that two or more bearing members 1 support a plurality of modules or segments in a substantially rectangular manner, each comprising lower and upper strips 2,4 made from resilient elastic material, as well as at least two spacers 3 which are laterally displaced with respect to the bearing members. The modules are held together by a fabric-like material 5, having pockets 5*a* in which can be placed the strips 2,4 hoses 5*b* in which the spacers 3 are guided and surfaces 5*c* between the upper and lower strips 2,4. It is also possible to place on the bearing members and modules a support 6 made from a breathable material, and this support, together with the modules, can be enclosed by an enclosing fabric 7.

I claim:

1. A bed or the like including a support structure for resiliently supporting a pad or the like on which a person can sit or lie, said support structure comprising first and second substantially parallel, elongated, spaced-apart bearing members;

a plurality of substantially identical elongated modules lying side-by-side on and generally perpendicular to said bearing members, each of said modules including first and second elongated, resilient strips extending substantially the entire length of said module, and a plurality of spacers positioned between said first and second strips to maintain said strips in generally parallel, spaced relationship with respect to each other, with said first strip above said second strip, said spacers being offset from said bearing members;

fabric means for loosely holding said modules together in generally parallel relationship while allowing substantially independent limited relative movement, said fabric means including pockets for receiving the ends of said strips, tubular portions for receiving said spacers and a sheet-like portion extending between said strips of said modules.

2. A structure according to claim 1 which includes a plurality of horizontally disposed, parallel bearing members of substantially equal length, the length of said members defining the length of a bed; at least ten modules each including first and second flexible strips each having a width of between about 6 and about 15 cm and a plurality of spacers between said strips, the number of spacers in each module being one greater than the number of bearing members, each spacer having a length substantially equal to the width of its associated strips, said strips being removably positioned in said pockets.

3. A structure according to claim 2 and further including a soft pad of breathable material lying on said modules, said pad having a thickness of between about 5 and 7 cm, and a removable fabric cover enclosing said pad, said modules and said fabric means for holding said modules and pad together.

4. A structure according to claim 3 wherein said fabric cover is reinforced along its lateral edges.

5. A structure according to claim 3 and further including a second support structure having bearing members, a second plurality of modules and fabric means for holding said modules together, said second support structure being adjacent the first said support structure with the upper surfaces thereof generally coplanar, and wherein said pad covers both of said support structures and said removable fabric cover encloses said pad and both of said support structures.

6. A structure according to claim 2 wherein each of said strips has a width of between about 7.5 and about 9 cm.

7. A structure according to claim 2 wherein each of said spacers has a length of between about 8 and about 10 cm.

8. A structure according to claim 2 wherein each of said spacers is made from a substantially incompressible material.

9. A structure according to claim 2 wherein each of said spacers has a generally circular cross section and a diameter of between about 4 and about 6 cm.

10. A structure according to claim 2 wherein said sheet-like portion of said fabric means is formed with two layers between said strips.

11. A structure according to claim 2 including two bearing members and three spacers in each module.

12. A structure according to claim 2 and including means insertable between said bearing members and selected ones of said modules to vary the surface configuration of said bed.

* * * * *